US007446467B2

(12) United States Patent
Tsuda et al.

(10) Patent No.: US 7,446,467 B2
(45) Date of Patent: Nov. 4, 2008

(54) IMAGE DISPLAY APPARATUS WITH PARTICULAR ION PUMP LOCATION

(75) Inventors: Hisanori Tsuda, Kanagawa-Ken (JP); Masaru Kamio, Kanagawa-Ken (JP); Ihachiro Gofuku, Kanagawa-Ken (JP); Yasue Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 498 days.

(21) Appl. No.: 11/203,196

(22) Filed: Aug. 15, 2005

(65) Prior Publication Data

US 2006/0043870 A1 Mar. 2, 2006

(30) Foreign Application Priority Data

Aug. 27, 2004 (JP) ..... 2004-248603

(51) Int. Cl.
*H01J 1/62* (2006.01)
*H01J 63/04* (2006.01)

(52) U.S. Cl. ..... 313/495; 313/496; 313/153; 313/359.1; 313/361.1

(58) Field of Classification Search ..... 313/495–497, 313/153, 160, 230, 359.1, 361.1
See application file for complete search history.

(56) References Cited

U.S. PATENT DOCUMENTS

| | | | | |
|---|---|---|---|---|
| 5,936,342 | A | 8/1999 | Ono et al. | 313/495 |
| 6,409,563 | B1 * | 6/2002 | Tamura et al. | 445/3 |
| 6,490,433 | B1 * | 12/2002 | Kawade | 445/6 |
| 6,608,437 | B1 * | 8/2003 | Kishi et al. | 313/495 |
| 6,726,520 | B2 | 4/2004 | Takeda et al. | 445/62 |
| 6,827,621 | B1 | 12/2004 | Enomoto et al. | 445/24 |
| 6,846,213 | B2 | 1/2005 | Sato | 445/6 |
| 6,848,961 | B2 | 2/2005 | Nomura et al. | 445/24 |
| 2004/0135505 | A1 | 7/2004 | Hasegawa et al. | 313/553 |
| 2005/0009433 | A1 | 1/2005 | Nomura et al. | 445/24 |
| 2005/0082963 | A1 * | 4/2005 | Miyazaki et al. | 313/493 |
| 2006/0043865 | A1 | 3/2006 | Gofuku et al. | 313/362.1 |
| 2006/0043866 | A1 | 3/2006 | Tsuda et al. | 313/365 |
| 2006/0043871 | A1 | 3/2006 | Kamio et al. | 313/495 |
| 2006/0049734 | A1 | 3/2006 | Sato et al. | 313/153 |
| 2006/0055637 | A1 | 3/2006 | Gofuku et al. | 345/75.2 |

FOREIGN PATENT DOCUMENTS

| | | |
|---|---|---|
| JP | 5-121012 | 5/1993 |
| JP | 9-82245 | 3/1997 |
| JP | 2000-133136 | 5/2000 |
| JP | 2000-315458 | 11/2000 |

* cited by examiner

*Primary Examiner*—Toan Ton
*Assistant Examiner*—Kevin Quaterman
(74) *Attorney, Agent, or Firm*—Fitzpatrick, Cella, Harper & Scinto

(57) ABSTRACT

An image display apparatus for forming an image in an image displaying region provided with a vacuum chamber having an electron source substrate and an image forming substrate has an ion pump for evacuating the vacuum chamber by an action of a magnet-filed-forming portion through an aperture portion formed in the electron source substrate or an image displaying substrate, wherein the magnet-filed-forming portion is arranged so that a shadow formed by perpendicularly projecting the magnet-filed-forming portion onto the electron source substrate or the image forming substrate can be located outside the image displaying region.

15 Claims, 7 Drawing Sheets

IMAGE DISPLAY APPARATUS WITH PARTICULAR ION PUMP LOCATION

BACKGROUND OF THE INVENTION

1. Field of the Invention

The present invention relates to an image display apparatus using an electron-emitting device.

2. Related Background Art

A flat panel display which arranges many electron-emitting devices as electron sources on a planar substrate, irradiates an phosphor of an imaging member on a substrate with an electron beam emitted from an electron source on the opposite side to make the phosphor emit light and display images, needs to keep the inside of a vacuum chamber including the electron source and the imaging members into a high vacuum. This is because when a gas is generated in the vacuum chamber and the pressure increases, the gas adversely exerts an adverse effect on the electron sources to decrease an electron emission amount and hinder the display of a bright image, though the extent of the effect depends on the types of the gas.

Gases generated from image display members accumulate in the vicinity of an electron source before reaching a getter installed outside an image display area, locally increase pressure and deteriorate the electron source, which is a peculiar problem particularly to a flat panel display. Japanese Patent Application Laid-Open No. H09-82245 describes a method of arranging the getter in an image displaying region and making it immediately adsorb the generated gases to inhibit the deterioration and damage of elements. In addition, Japanese Patent Application Laid-Open No. 2000-133136 shows a configuration in which a non-evaporable getter is arranged in the image displaying region, and a evaporable getter is arranged outside the image displaying region. Furthermore, Japanese Patent Application Laid-Open No. 2000-315458 shows a method of performing a series of operations including degassing, getter forming and seal bonding (making a chamber into a vacuum) in an evacuating chamber.

There are a evaporable getter and a non-evaporable getter in getters. The evaporable getter has an extremely high speed of eliminating water and oxygen, but has a speed close to zero of eliminating an inert gas such as argon (Ar), as well as the non-evaporable getter has. Argon gas is ionized by an electron beam to become positive ions, which are accelerated in an electric field for accelerating electrons, and bombard the electron source to damage the electron source. The positive ions further may discharge inside the vacuum chamber and damage an apparatus.

On the other hand, Japanese Patent Application Laid-Open No. H05-121012 describes a method of connecting a sputter ion pump to a vacuum chamber of a planar display and keeping the vacuum chamber into a high vacuum for a long time. However, the planar display needs a strong magnet, and then a magnetic field deflects an electron orbit of the display and may affect images.

SUMMARY OF THE INVENTION

The present invention is designed with respect to such problems, and is directed at providing an image display apparatus with the use of an ion pump, which reduces an influence of a magnetic field, has little nonuniformity in brightness in an image-forming region and hardly causes the change of the brightness with time, and at a manufacturing method therefor.

The present invention provides an image display apparatus provided with a vacuum chamber that is constituted by an electron source substrate having a plurality of electron-emitting devices arranged thereon, and by an image forming substrate which is arranged so as to face the electron source substrate, and has a phosphor film and an anode electrode film thereon, wherein an ion pump is connected to an aperture portion formed in the electron source substrate or the image forming substrate, in such a way that a shadow formed by perpendicularly projecting magnetic field generating means of the ion pump onto the electron source substrate or the image forming substrate can not exist in the image displaying region of the image display apparatus.

The present invention also provides an image display apparatus comprising: a vacuum chamber that is constituted by a rear substrate having an image displaying region containing a plurality of electron-emitting devices arranged on the surface, and by a face substrate which is arranged so as to face the rear substrate, and has a phosphor film and an anode electrode film thereon; and an ion pump which is connected to an aperture portion formed in the rear substrate, and has magnetic field generating means arranged on the back surface of the rear substrate, wherein there is a space between a region orthogonally projected by the magnetic field generating means on the back surface of the rear substrate and the region on the back surface of the rear substrate corresponding to the image displaying region.

DESCRIPTION OF THE PREFERRED EMBODIMENTS

Figure 1:
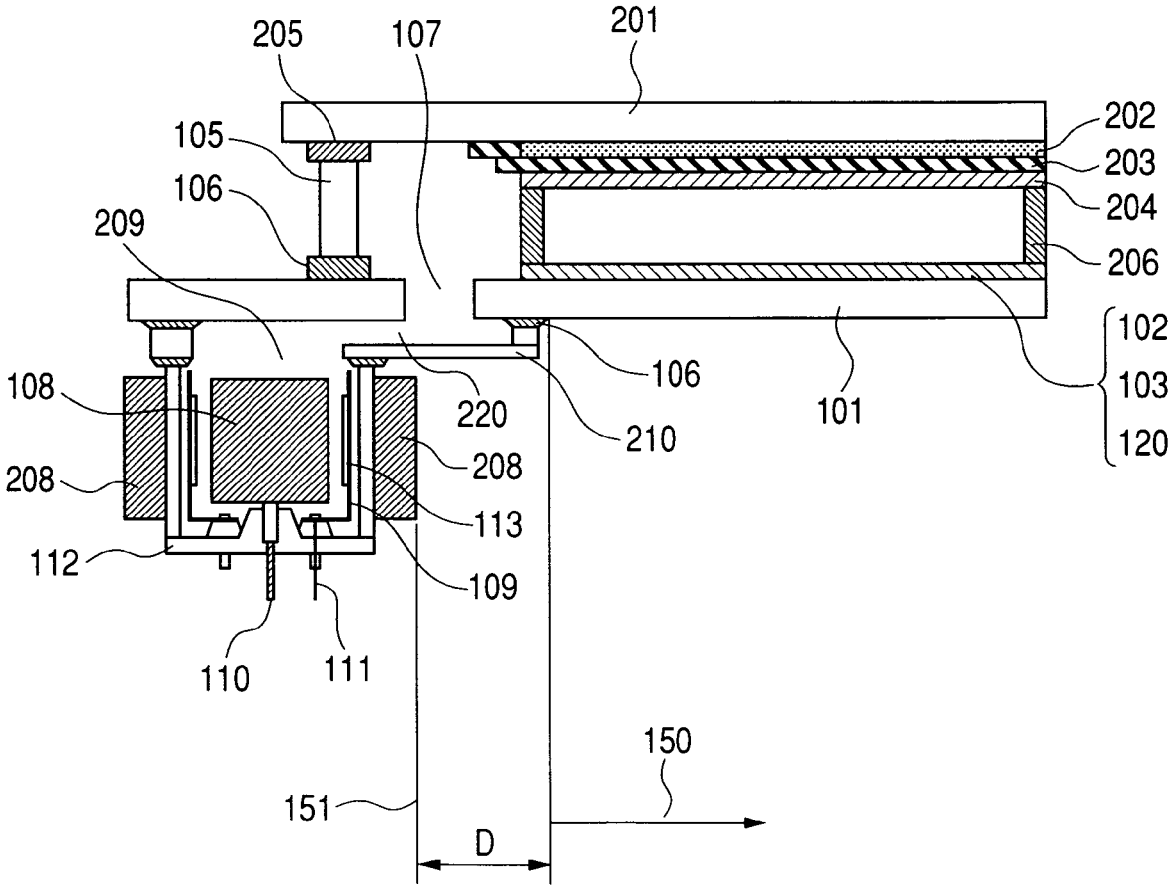
FIG. 1 is a sectional view of a configuration showing one embodiment of an image display apparatus according to the present invention.

The present invention relates to an image display apparatus provided with a vacuum chamber that is constituted by an electron source substrate having a plurality of electron-emitting devices arranged thereon, and by an image forming substrate which is arranged so as to face the electron source substrate, and has a phosphor film and an anode electrode film thereon, wherein an ion pump is connected to an aperture portion formed in the electron source substrate or the image forming substrate, in such a way that a shadow formed by perpendicularly projecting magnetic field generating means of the ion pump onto the electron source substrate or the image forming substrate can not exist in the image displaying region of the image display apparatus.

The present invention also relates to an image display apparatus comprising: a vacuum chamber that is constituted by a rear substrate having an image displaying region containing a plurality of electron-emitting devices arranged on the surface, and by a face substrate which is arranged so as to face the rear substrate, and has a phosphor film and an anode electrode film thereon; and an ion pump which is connected to an aperture portion formed in the rear substrate, and has magnetic field generating means arranged on the back surface of the rear substrate, wherein there is a space between a region orthogonally projected by the magnetic field generating means on the back surface of the rear substrate and the region on the back surface of the rear substrate corresponding to the image displaying region.

In this case, it is preferable that the projected shadow is 1 mm or more distant from an image displaying region, or that the space is 1 mm or wider.

In a configuration of the present invention, magnetic field generating means of an ion pump is located outside an image displaying region, and accordingly exerts extremely little effect of a magnetic field on an orbit of an electron emitted from an electron-emitting device to a phosphor. As a result, the configuration according to the present invention can provide such an image display apparatus as to show brightness extremely less reduced even in the part close to the ion pump of a display compared to that in the center of the display.

In addition, by displacing the central axis of an aperture portion in a vacuum chamber from that of the main body of an ion pump, an orbit of an electron directing to a phosphor from an electron-emitting device can become hardly affected by the magnet of the ion pump. Even in this case, the ion pump can have sufficient exhaust velocity, and consequently can adequately secure the life of the image display apparatus.

When an image display apparatus employs a raising member to form a communicating path, it can make an ion pump greatly displaced from an aperture portion, and consequently easily reduce an influence of the magnet of the ion pump. In this case, the raising member enables the ion pump to exhaust ions without decreasing conductance from an image forming substrate to the ion pump. Even when the image display apparatus employs the raising member, it only increases depth by the maximum raised distance, so that the provided image display apparatus can be compact, lightweight and highly reliable.

A preferred embodiment will be described in detail below with reference to drawings. An image evaluation apparatus according to the present invention will be now described with reference to FIGS. 1 to 7. In the following explanation, an electron source substrate will be explained as a rear substrate (a rear plate) and an image forming substrate as a face substrate (a face plate).

[Explanation of Position of Ion Pump]

Figure 2A:
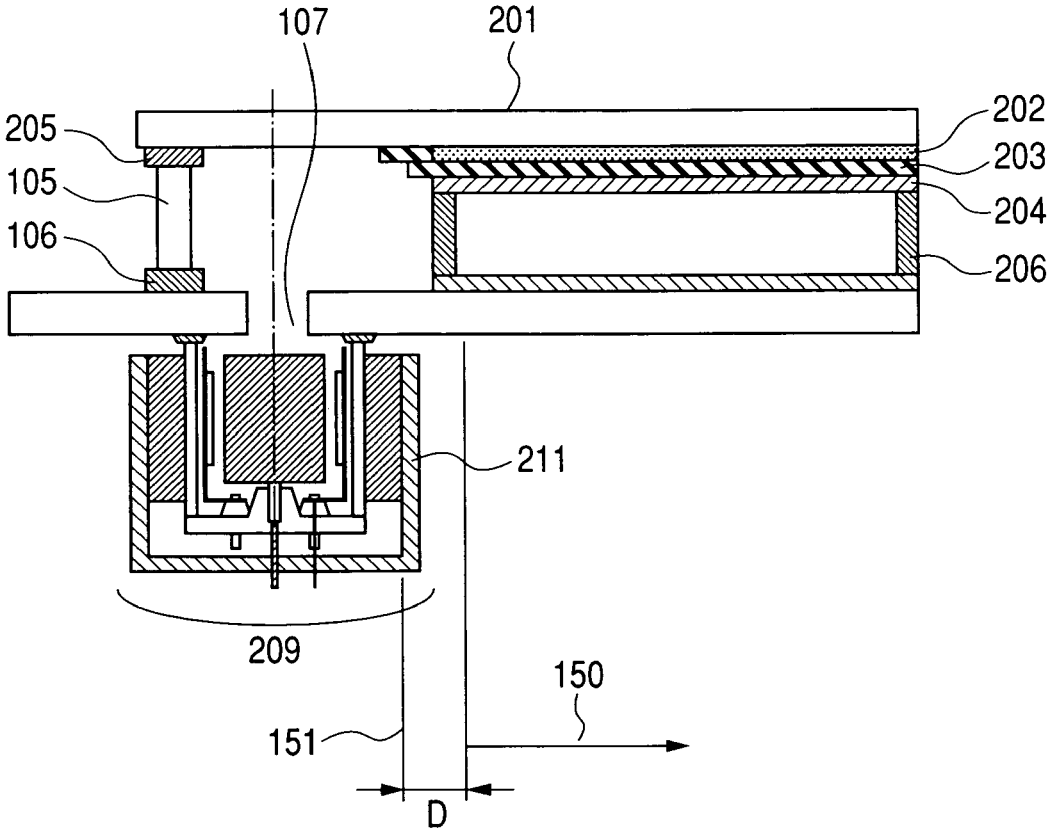
FIGS. 2A and 2B are sectional views of a configuration showing one embodiment of an image display apparatus according to the present invention.
Figure 2B:
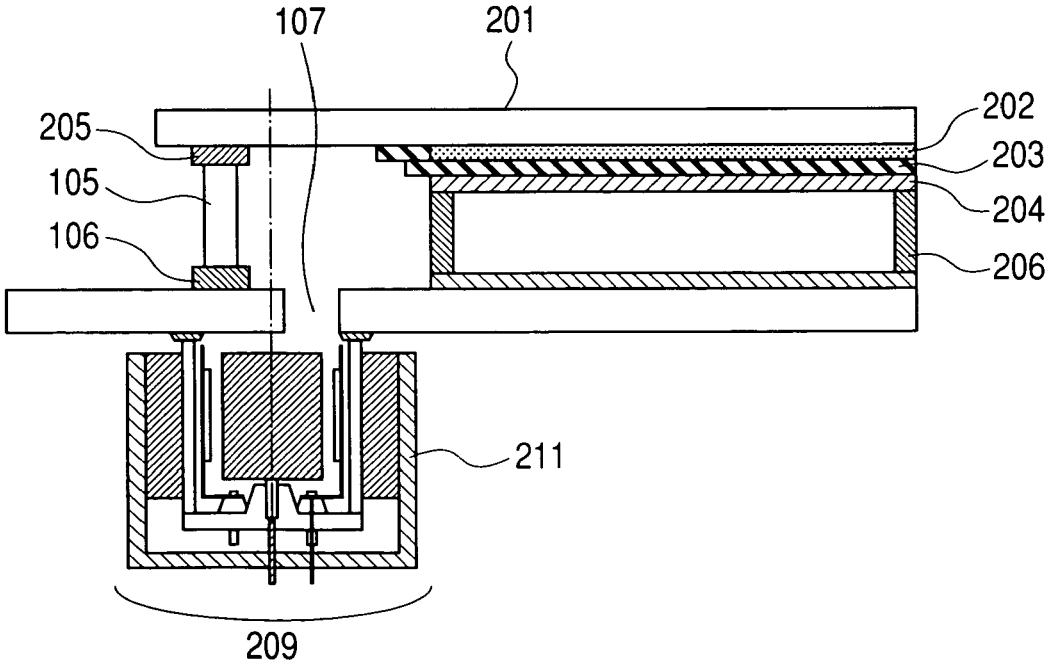
Figure 3:
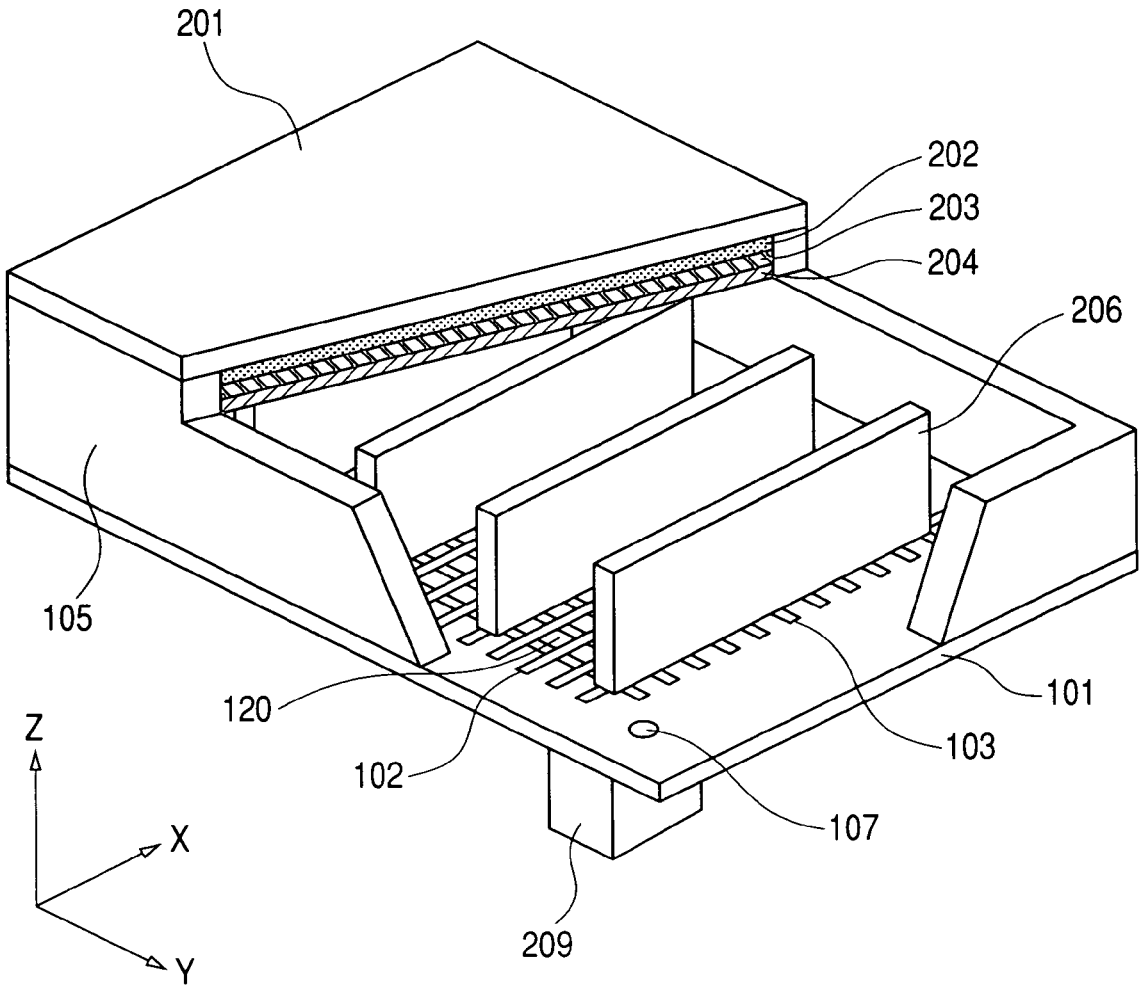
FIG. 3 is a schematic view of a configuration showing an image display apparatus according to the present invention.

FIGS. 1 to 3 show examples of a schematic view showing a configuration of an image display apparatus according to the present invention. As is shown in FIG. 1, a rear plate 101 has upper wiring 102, lower wiring 103 and a surface conduction type electron-emitting device (an electron source) 120 of an electron-emitting member having an electron-emitting portion formed thereon, on the inner side (surface) of a transparent glass substrate; a face plate 201 has a phosphor film 202 coated on the inner side (surface) of the transparent glass substrate, a metallic back film 203 which is an anode electrode film, and a getter film 204; a supporting frame 105 is connected to the rear plate 101 with frit glass 106; and an ion pump 209 is connected to an exhaust port 107 of the rear plate 101 with the frit glass 106. The supporting frame 105 and the face plate 201 are heated and seal-bonded with the use of a metal such as indium 205 in a vacuum to form an envelope which is a vacuum chamber.

An ion pump 209 has an anode electrode 108, a cathode electrode 109, an anode connecting terminal 110 and a cathode connecting terminal 111 which are fixed and accommodated inside an ion pump casing 112, and a magnet 208 is provided outside the ion pump casing 112. An anode connecting terminal 110 and a cathode connecting terminal 111 are connected to an ion pump power source (not shown) for driving the ion pump, by wiring. The used magnet 208 is magnetic field generating means, and is a permanent magnet in this example, but may be magnetic field generating means such as an electric magnet.

An image display apparatus according to the present invention has a magnet 208 of an ion pump 209 arranged at a position apart from an image displaying region, and not on either of a face plate or a rear plate respectively above or below the image displaying region. Specifically, as is shown in FIG. 1, when the magnet 208 is projected perpendicularly onto the rear plate or the face plate, the region of the shadow (or equivalently, orthographic projection region) formed on the back surface of the rear plate or the face plate does not come in the image displaying region 150. Here, the image displaying region is the region having an electron source and the phosphor film corresponding thereto arranged thereon, and is the region which emits light and displays images. If the image displaying region will be described further in detail, it is the region which is enclosed by a line that links the electron-emitting devices arranged in the most outside among a plurality of electron-emitting devices arranged on the rear plate, or the region which is enclosed by a line that links picture elements of which the phosphor film on the face plate emits light excited by electrons emitted from the above described electron-emitting device arranged in the most outside. In addition, a perpendicular line 151 is the nearest line to the image displaying region among the lines formed when the magnets 208 are projected perpendicularly to the rear plate and the face plate.

When reference character D is defined as the shortest distance between an image displaying region 150 and a perpendicular line 151, the reference character D is preferably 1 mm or longer, and particularly preferably 5 mm or longer. However, when the distance is too much, the size of a substrate becomes large, so that the distance shall be normally 25 mm or shorter, and preferably 20 mm or shorter.

It is conceivable as a method for separating a magnet of an ion pump from an image displaying region, to arrange an aperture portion at a position sufficiently apart from an image displaying region in a vacuum chamber. However, in this case, the space which is not concerned with displaying images is expanded in the vacuum chamber, which is useless because of increasing weight and increasing a volume to be kept into a vacuum.

For this reason, in one embodiment according to the present invention, the center of an ion pump is preferably displaced from an aperture portion 107 installed in the above described vacuum chamber, in a transverse direction. In FIG. 1, the vacuum chamber is connected to the ion pump through a communicating path 220 provided in the aperture portion 107. By providing the communicating path, the center of the ion pump can be greatly displaced in a transverse direction with respect to the aperture portion 107. Particularly, as is shown in FIGS. 1 to 9 (a sectional view of FIG. 1 perpendicularly cut to the paper surface), the communicating space of the communicating path is preferably formed so as to be surrounded by a back surface of a substrate of a rear plate or a face plate (though FIG. 1 shows an example of using the rear plate 101), which is used as one wall surface, and the other three sides of a raising member 210. By elongating the communicating path, the raising member 210 exists in the perpendicular direction of the aperture portion 107, and the position of magnetic field generating means can be greatly separated from an image displaying region. The size of the communicating path composed of the rear plate or the face plate and the raising member can be appropriately determined in consideration of the conductance in exhausting ions. For instance, in FIG. 9, an inner height of the communicating path is preferably 3 to 20 mm, and particularly preferably 5 to 10 mm.

A method of connecting an ion pump to a vacuum chamber through thus formed communicating path does not need to enlarge a space in a vacuum chamber; has only to increase the size of only either of a rear plate or a face plate, as needed; and besides, has only to increase only a slight height for a raising member and minimizes the increase of the depth of an apparatus.

A raising member and an ion pump casing 112 can be made into one piece, and an electrode section of an ion pump can be made in the integrated raising member and ion pump casing 112, so that the raising member can be used without increasing a depth of an image display apparatus.

In the present invention, a material for an ion pump casing and a raising member composing a communicating path can be appropriately selected among glass, ceramic and metal. The material can be preferably joined to a rear plate or a face plate with frit glass, and molded glass and a glass structure made of glass plates joined with the frit glass is preferably used from the viewpoint of weight and size reduction.

Figure 10:
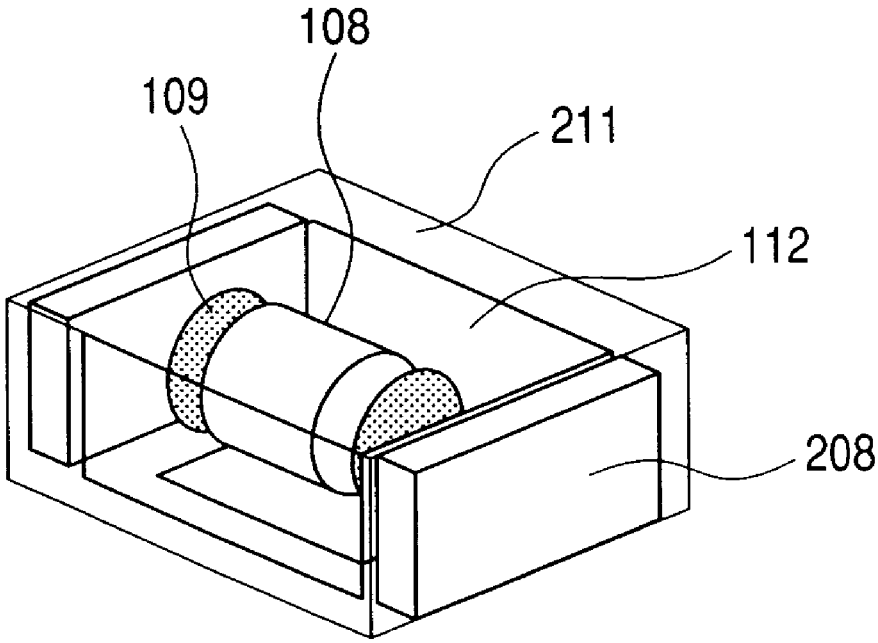
FIG. 10 is a view showing an ion pump having a magnet to which a yoke is attached.

In a different embodiment according to the present invention, a magnet of magnetic field generating means is provided with a yoke (a ferromagnet). For instance, as is shown in FIG. 2A, an ion pump is covered with the yoke 211 which can form a magnetic circuit. For instance, as is diagrammatically shown in FIG. 10, the yokes 211 may cover the whole ion pump from five directions, or may cover it from three directions while making only one direction into a bridge structure. In FIG. 10, an anode connecting terminal and a cathode connecting terminal are not shown. By installing the yoke, the spread of a magnetic flux can be limited, so that the yoke reduces the influence of the magnetic flux on images, as long as a perpendicular line 151 dropped from the edge of a magnet onto a rear plate or a face plate does not come into an image displaying region 150. In addition, the yoke can increase the magnetic flux density of an effective portion, and accordingly can thin the magnet. A ferromagnetic substance such as iron can be used for the material of the yoke. When the yoke is installed, reference character D is preferably 3 mm or longer, and is particularly preferably 7 mm or longer. However, when the distance is too much, the size of a substrate becomes large, so that the distance shall be normally 30 mm or shorter, and preferably 20 mm or shorter. Furthermore, a position of the yoke projected perpendicularly to the electron source substrate or the image forming substrate has to be out of a range of the image displaying region of the image display apparatus, in other words, the position of an ion pump including the yoke is preferably separated from the image displaying region. If the shortest distance between a foot of a perpendicular line dropped from the yoke and the displaying region is defined as D', D' is preferably 1 mm or longer, and particularly preferably 5 mm or longer. However, when the distance is too much, the size of a substrate becomes large, so that the distance shall be normally 30 mm or shorter, and preferably 20 mm or shorter.

FIG. 2B is a view showing a configuration in which the central axis of an ion pump 209 is displaced from the central axis of an aperture portion 107 installed in the above described vacuum chamber. In the figure, the aperture portion 107 is installed nearer to an image displaying portion than that in FIG. 2A. The installed a yoke 211 can reduce an effect of a magnetic force exerting on an image displaying region, but when a magnet is right under an image displaying region, the image displaying region remarkably receives the effect of the magnetic force. Accordingly, in the configuration, by displacing the central line of the ion pump 209 from the central axis of the aperture portion 107, the yoke is placed so that the foot of a perpendicular line dropped from the edge of the yoke onto the rear plate or the face plate can come to the outside of the image displaying region. By approaching the image displaying region to the aperture portion, the inner space of the vacuum chamber can be reduced. In addition, if the central axis of the ion pump is displaced from the central axis of the aperture portion 107, in the positional relationship between the aperture portion and the image displaying portion in FIG. 2A, the magnet becomes more distant from the image displaying portion, which further reduces the effect of the magnetic field on images.

Furthermore, when a supporting frame 105 is arranged close to an electron-emitting device (electron source) 120, a path from the vacuum chamber to the space in an ion pump casing 112 can be provided by installing a communicating path as in FIG. 1, so as to separate the main body of an ion pump 209 from an aperture portion 107.

A plurality of ion pumps may be used, and the ion pump may be, of course, attached to a face plate side.

[Explanation of Whole Image Display Apparatus]

A whole image display apparatus will be now described below. An image display apparatus shown in FIG. 3 displays an image by applying voltage for a modulating signal input from a terminal outside a vessel (not shown) through lower wiring 103, and voltage for a scan signal input through upper wiring 102, and applying high voltage from a high-voltage terminal Hv (not shown). An ion pump 209 is connected to a vacuum chamber through an exhaust port 107, and a released gas is exhausted through the exhaust port by driving an ion pump by the power source (not shown). In the same figure, reference numeral 120 denotes a surface conduction type electron-emitting device which is an electron source, and reference numerals 102 and 103 denote upper wiring (Y-direction wiring) and lower wiring (X-direction wiring) connected to a pair of element electrodes of the surface conduction type electron-emitting device.

Figure 4A:
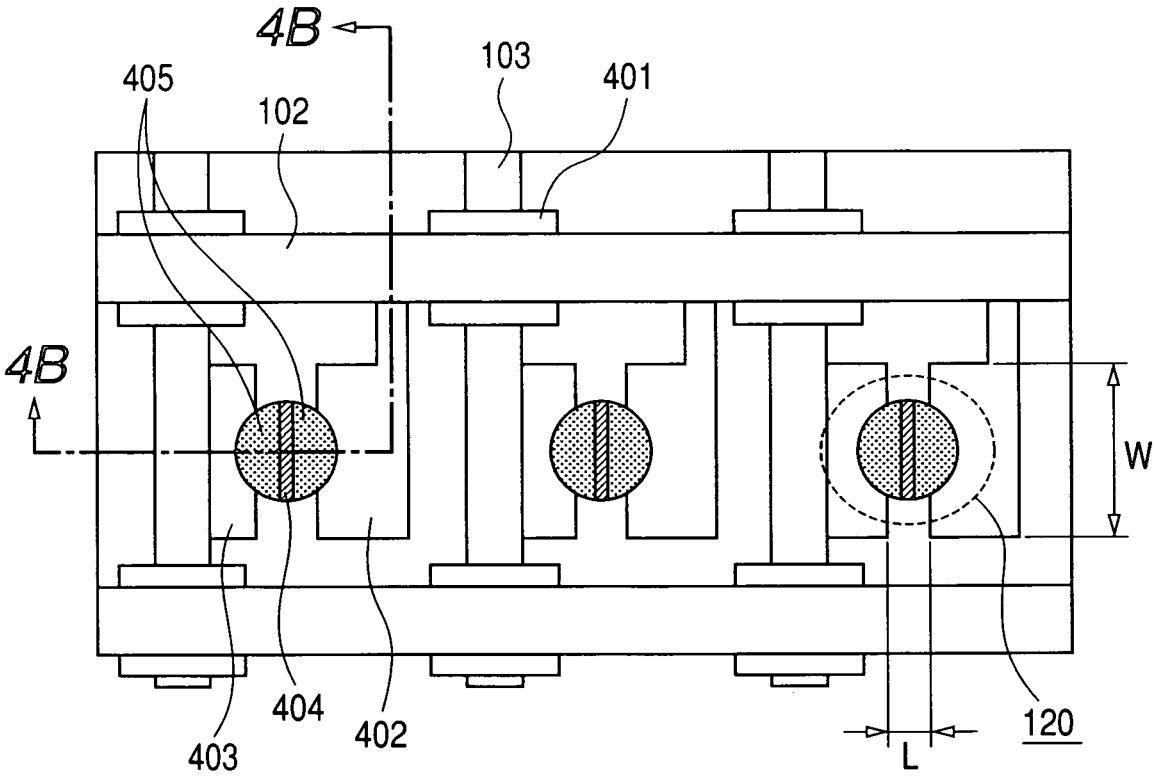
FIGS. 4A and 4B are views for explaining an electron source.

FIG. 4A is a schematic view showing a surface conduction type electron-emitting device 120 arranged on a rear plate 101, and one part of wiring and the like for driving the electron source. In the same figure, reference numeral 103 denotes lower wiring, reference numeral 102 denotes upper wiring, and reference numeral 401 denotes an interlayer insulating film which electrically insulates the upper wiring 102 from the lower wiring 103.

Figure 4B:
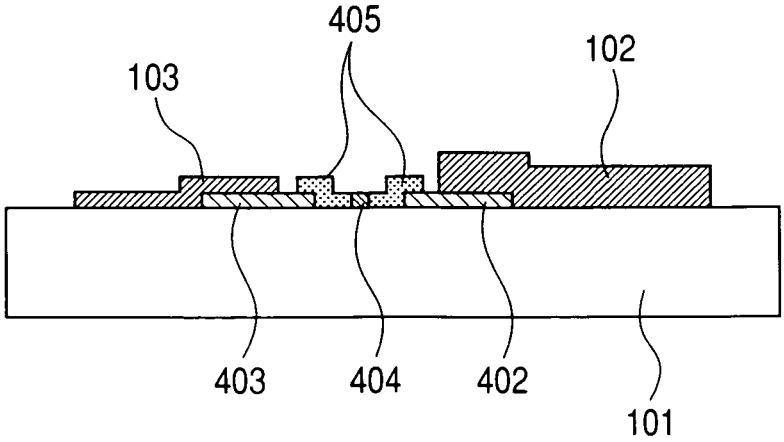

FIG. 4B shows an enlarged sectional view of the structure of a surface conduction type electron-emitting device 120 along a line 4B-4B in FIG. 4A, and reference numerals 402 and 403 denote element electrodes, reference numeral 405 denotes an electroconductive thin film, and reference numeral 404 denotes an electron-emitting portion.

In the first place, an example of an image display apparatus using a surface conduction type electron-emitting device will be described.

In a configuration shown in FIGS. 2A, 2B and FIG. 3, a rear plate 101 is made of an insulating substrate such as a glass substrate having soda glass, borosilicate glass, quartz glass and $SiO_2$ formed on the surface, and a ceramic substrate such as alumina, and a face plate 201 is made of a glass substrate such as transparent soda glass.

A usable material for element electrodes (corresponding to 402 and 403 in FIGS. 4A and 4B) of a surface conduction type electron-emitting device 120 is a general conductor, and is appropriately selected among, for instance, a metal such as Ni, Cr, Au, Mo, W, Pt, Ti, Al, Cu and Pd or an alloy thereof, a printed conductor comprising a metal such as Pd, Ag, Au, $RuO_2$ and Pd—Ag, or a metal oxide thereof and glass, a transparent electric conductor such as $In_2O_3$—$SnO_2$, and a semiconductor material such as a polysilicon.

An element electrode can be formed by the steps of: forming the film of above described electrode material with the use of a vacuum deposition method, a sputtering method and a chemical-vapor deposition method; and processing it into a desired shape with a photolithographic technology (including a processing technique such as etching and liftoff) or other printing methods. To sum up, the above described element electrode material has only to be formed into the desired shape, and may be processed with any method.

A space L between element electrodes shown in FIG. 4A is preferably several hundred nanometers to several hundred micrometers. Because the element electrodes are required to be processed with adequate reproducibility, the space L between the element electrodes is more preferably several micrometers to several tens of micrometers. The length W of the element electrode is preferably several micrometers to several hundred micrometers in consideration of the ohmic value and electron emission characteristics of the electrodes, and the film thicknesses of the element electrodes 402 and 403 are preferably several tens of nanometers to several micrometers. The configuration is not limited to only one shown in FIG. 4B, but may be another one having an electroconductive thin film 405 and an element electrode 402 and an element electrode 403 sequentially formed on a rear plate 101.

An electroconductive thin film 405 is particularly preferably a film composed of fine particles in order to provide adequate electron emission characteristics, and has a film thickness preferably of 0.1 nm to several hundred nanometers, and particularly preferably of 1 to 50 nm, though it is set according to a step coverage onto element electrodes 402 and 403, an ohmic value between the element electrodes 402 and 403, and an energization forming condition to be described later. The ohmic value Rs is $10^2$ to $10^7$ Ω/square. The above Rs is a quantity appearing when a resistance R of a thin film has a thickness of t, a width of w and a length of l, and has a relationship-expressed by R=Rs(l/w).

In addition, a material of composing an electroconductive thin film 405 includes a metal such as Pd, Pt, Ru, Ag, Au, Ti, In, Cu, Cr, Fe, Zn, Sn, Ta, W and Pb, an oxide such as PdO, $SnO_2$, $In_2O_3$, PbO and $Sb_2O_3$, an boride such as $HfB_2$, $ZrB_2$, $LaB_6$, $CeB_6$, $YB_4$ and $GdB_4$, a carbide such as TiC, ZrC, HfC, TaC, SiC and WC, a nitride such as TiN, ZrN and HfN, a semiconductor such as Si and Ge, and carbon. In addition, a fine particle film described here is a film in which a plurality of fine particles aggregate, and has a fine structure in which the fine particles are not only separately dispersed and placed, but also are contacted or overlapped with each other (including forming islands). Here, the fine particles have diameters of 0.1 nm to several hundred nanometers, and preferably of 1 to 20 nm.

An electroconductive thin film 405 is prepared by the steps of: forming element electrodes 402 and 403 on a rear plate 101; and forming an organic metal thin film thereon by applying an organometallic solution and drying it. The organometallic solution described here means a solution of organometallic compounds containing a metal of forming the above described electroconductive thin film 405 as a main element.

An electroconductive thin film 405 is formed by subsequently heating an organometallic thin film to bake it, and patterning the baked thin film by lift-off, etching and the like. In the above description, a method for forming the electroconductive thin film 405 by applying an organometallic solution was described, but is not limited thereto, and the electroconductive thin film may be formed with a vacuum deposition method, a sputtering method, a chemical-vapor deposition method, a dispersion application method, a dipping method and a spinner method.

An electron-emitting portion 404 is a crack with a high resistance, formed on one part of an electroconductive thin film 405, and is formed by treatment called energization forming. The energization forming is treatment for changing the structure of the electroconductive thin film 405 into a new structure, by passing an electric current between element electrodes 402 and 403 from electrodes which are not shown in the figure, and locally braking, deforming or deteriorating the electroconductive thin film 405. A voltage waveform during energization is particularly preferably a pulse form, and an energization method includes a method of continuously applying voltage pulses with constant pulse height, and a method of applying the voltage pulses while increasing the pulse height. Forming treatment is not limited to energization treatment, but may employ treatment of forming a space such as a crack in the electroconductive thin film 405 to make the film into a high-resistance condition.

The element having the treatment of energization forming finished thereon is preferably subjected to treatment called activation. The activation treatment is the treatment of remarkably changing an element current (an electric current passing between element electrodes 402 and 403) and an emission current (an element current emitted from an electron-emitting portion 404). The activation treatment can be performed, for instance, by repeating the application of pulses as in the case of the energization forming, under an atmosphere containing a gas of a carbon compound such as a gas of an organic substance. A preferred pressure in a gaseous atmosphere of the organic substance employed at this time is appropriately set according to cases, because the pressure differs according to the shape of a vacuum chamber of arranging an element therein and the type of an organic substance.

Activation treatment deposits an organic substance existing in an atmosphere on an electroconductive thin film 405, and forms an organic thin film consisting of carbon or carbon compounds.

Activation treatment is finished when an element current and the emission current are measured, and for instance, an emission current saturates. A voltage pulse to be applied for the activation treatment has preferably equal voltage to or higher voltage than an operation-driving voltage when images are displayed.

A formed crack may contain electroconductive fine particles therein with diameters of 0.1 nm to several tens of nanometers. The electroconductive fine particles contain at least one part of elements of substances composing an electroconductive thin film 405. In addition, an electron-emitting portion 404 and the electroconductive thin film 405 around it occasionally contain carbon and carbon compounds.

In addition, a surface conduction type electron-emitting device 120 may be not only a flat type having the surface conduction type electron-emitting device 120 formed on a rear plate 101 in a flat form, but also a perpendicular type having the surface conduction type electron-emitting device 120 formed on the surface perpendicular to the rear plate 101; and is not particularly limited and has only to be an element for emitting electrons, in a word, any electron-emitting device used in an image display apparatus, such as a thermal electron source using a thermal cathode and a field emission type electron-emitting device.

In the next place, the arrangement of a surface conduction type electron-emitting device 120 and wiring for supplying electric signals (an electric power) for displaying an image to the device will be described with reference to FIG. 3 and FIGS. 4A and 4B.

An example of usable wiring can be a combination of two wirings which are perpendicular each other (Y: upper wiring 102 and X: lower wiring 103, which are called simple matrix wiring). In the wirings, the upper wiring 102 is connected to an element electrode 402 of a surface type electron-emitting device 120, and the lower wiring 103 is connected to an element electrode 403 of the device 120. The upper wiring 102 and the lower wiring 103 can be formed of an electroconductive metal or the like with a vacuum deposition method, a printing method such as a screen printing method and an offset printing method, and a sputtering method; and the materials, the film thicknesses and the widths are appropriately designed. Among them, the printing method is preferably used because of manufacturing the wirings at a low cost and easily being handled.

An electroconductive paste to be used includes a single noble metal such as Ag, Au, Pd and Pt, a single base metal such as Cu and Ni, or arbitrarily combined metals thereof. A wiring pattern is formed by printing the paste with a printing machine, and baking it at 500° C. or higher. The formed upper and lower printed wirings have thicknesses of several micrometers to several hundred micrometers. Furthermore, at least in a position in which the upper wiring 102 and the lower wiring 103 are overlapped, an interlayer insulating film 401 with a thickness of several micrometers to several hundred micrometers is formed by printing the glass paste and baking it (at 500° C. or higher) to electrically isolate the wirings.

The end of upper wiring 102 in a Y direction is electrically connected to a driving circuit of means for driving a scan side electrode, so that a scan signal of an image display signal for scanning the row of the Y side of a surface conduction type electron-emitting device 120 in response to an input signal can be applied to the upper-wiring 102. On the other hand, the end of lower wiring in the X direction is electrically connected to a driving circuit of means for driving a modulating signal, so that a modulating signal of an image display signal for modulating each column of the surface conduction type electron-emitting device 120 in response to an input signal can be applied to the lower wiring.

A phosphor film 202 coated on the inner face of a face plate 201 is made of a single phosphor in a monochrome display, but in a display for showing color images, has a structure of separating the phosphors of emitting lights of the three primary colors of red, green and blue with a black electroconductive material. The black electroconductive material is called a black stripe or a black matrix according to its shape. The phosphor film consisting of the phosphors with each color is formed by applying phosphor slurry, and patterning it into picture elements having desired sizes with a photolithographic method or a printing method.

On a phosphor film 202, a metallic back film 203 of an anode electrode film is formed. The metallic back film 203 is formed of an electroconductive film such as Al. The metallic back film 203 reflects the light which travels in a direction toward a rear plate 101 of an electron source among the lights generated in the phosphor film 110, to improve the brightness of an image. Furthermore, the metallic back film 203 gives electroconductivity to an image display region of a face plate 201 to prevent the accumulation of electric charge, and plays a role of an anode electrode for a surface conduction type electron-emitting device 120 on the rear plate 101.

The metallic back film 203 has also a function of preventing the phosphor film 202 from being damaged by ions formed by a reaction in which gases remaining in the face plate 201 and the image display apparatus are ionized with electron beams.

A metallic back film 203 to which a high voltage is applied, shall be electrically connected to a high-voltage-applying device.

A supporting frame 105 hermetically seals a space between a face plate 201 and a rear plate 101. The supporting frame 105 composes a sealed vessel of an envelope by being connected to the face plate 201 with the use of In (indium) 205, and being connected to the rear plate 101 with frit glass 106. In the above step, the supporting frame 105 can be connected to the rear plate 101 with In. The supporting frame 105 can employ the same material as the face plate 201 and the rear plate 101, or glass, ceramic or metal having a similar coefficient of thermal expansion to them.

A supporting frame 105 and an ion pump casing 112 are preferably connected to a rear plate 101 with frit glass 106, before an electron-emitting portion 404 is formed, in other words, before it is subjected to forming treatment and activation treatment. In the case of connecting the supporting frame 105 to a face plate 201 with In, the supporting frame 105 is preferably connected to the face plate 201 and the rear plate 101 at the same time when forming a closed vessel with them. For instance, the supporting frame 105 is connected to the rear plate 101 with the frit glass 106.

The usable base material of frit glass includes $SiO_2$-based glass, Te-based glass, PbO-based glass, $V_2O_5$-based glass and Zn-based glass according to the component. Practically used glass contains oxide fillers which are added to the base material to obtain a controlled coefficient of thermal expansion a. The above described refractory filler includes $PbTiO_3$, $ZrSiO_4$, $Li_2O—Al_2O_3$-$2SiO_2$, $2MgO$-$2Al_2O_3$-$5SiO_2$, $Li_2O—Al_2O_3$-$4SiO_3$, $Al_2O_3—TiO_2$, $2ZnO—SiO_2$, $SiO_2$ and $SnO_2$. A mixture obtained by mixing one or more fillers among them can be appropriately used as the frit glass.

In a case where frit glass has been used for joining by being baked in a vacuum atmosphere, the baking is accompanied by foaming and the frit glass cannot secure adhesive strength and hermeticity. Accordingly, it is preferable that the frit glass is temporarily baked in the atmosphere, is heated in a vacuum atmosphere for the purpose of defoaming, and then is used for joining.

Because frit glass is a powder, it is converted to a paste form with the use of an organic binder, and is applied to an area to be connected when it is used. A method for applying the frit glass which has been made pasty is generally a dispense method using an air pressure, but can appropriately employ a dipping method and a printing method. Alternatively, a preformed article can be used which has been previously formed into a ring-shaped or strip-shaped sheet, then temporarily baked and degassed.

Because frit glass becomes somewhat flowable at a baked temperature when baked, a pressing pressure for flattening it is required, and a preferably used pressing pressure is 0.5 g/mm$^2$ or higher.

An ion pump casing 112 is connected to the rear plate 101 with the frit glass 106 in the same way as the supporting frame 105 was. Various materials and bonding procedures are adaptable to the connection of the ion pump casing 112, as long as having adequate vacuum sealing properties.

After a rear plate 101 having been connected to a supporting frame 105 and an ion pump casing 112 and a face plate 201 have been prepared, they are subjected to the steps of: electron beam cleaning for the substrates, formation of a getter film 204 by vapor deposition, and formation of a sealed vessel of an envelope (connection of the face plate 201 to the rear plate 101 to which the supporting frame 105 and the ion pump casing 112 have been connected), which are performed in an atmosphere kept to a vacuum.

Figure 6:
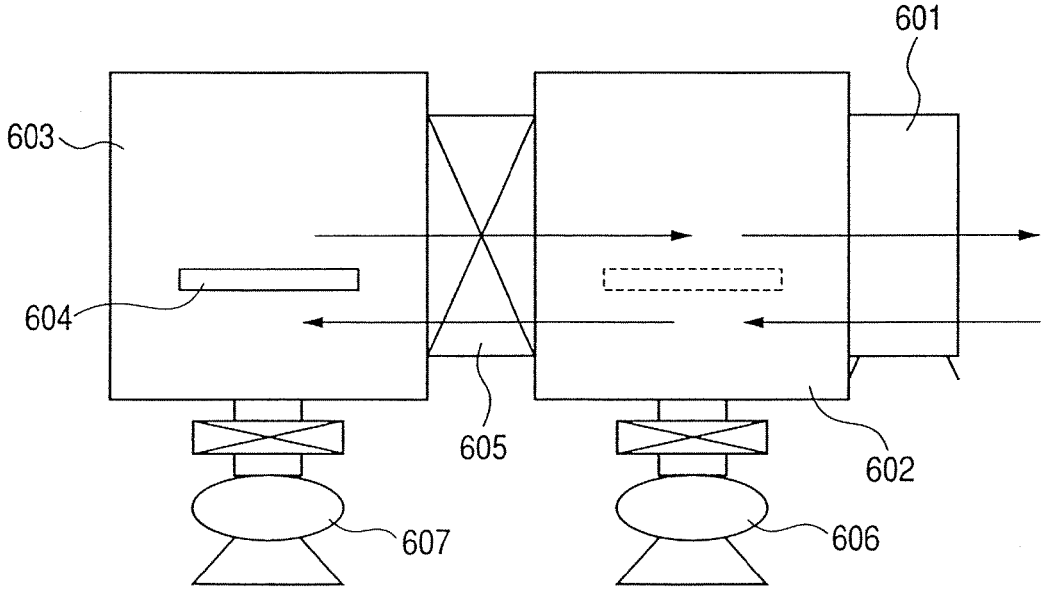
FIG. 6 is a schematic view of a configuration showing a vacuum treatment apparatus for manufacturing an image display apparatus.

FIG. 6 shows a whole conceptional diagram of a vacuum treatment apparatus used in the present invention. A load chamber 602 is used for importing and exporting a substrate, and a vacuum treatment chamber 603 is used for baking it, forming a getter film thereon and seal bonding it therein. A gate valve 605 is installed to separate the load chamber 602 from the vacuum treatment chamber 603, and a transportation holder 604 transports the substrate. The load chamber 602 is evacuated by evacuating means 1 (606), and the vacuum treatment chamber 603 is evacuated by evacuating means 2 (607). The substrate is exported and imported through an exporting and importing port 601.

Figure 7:
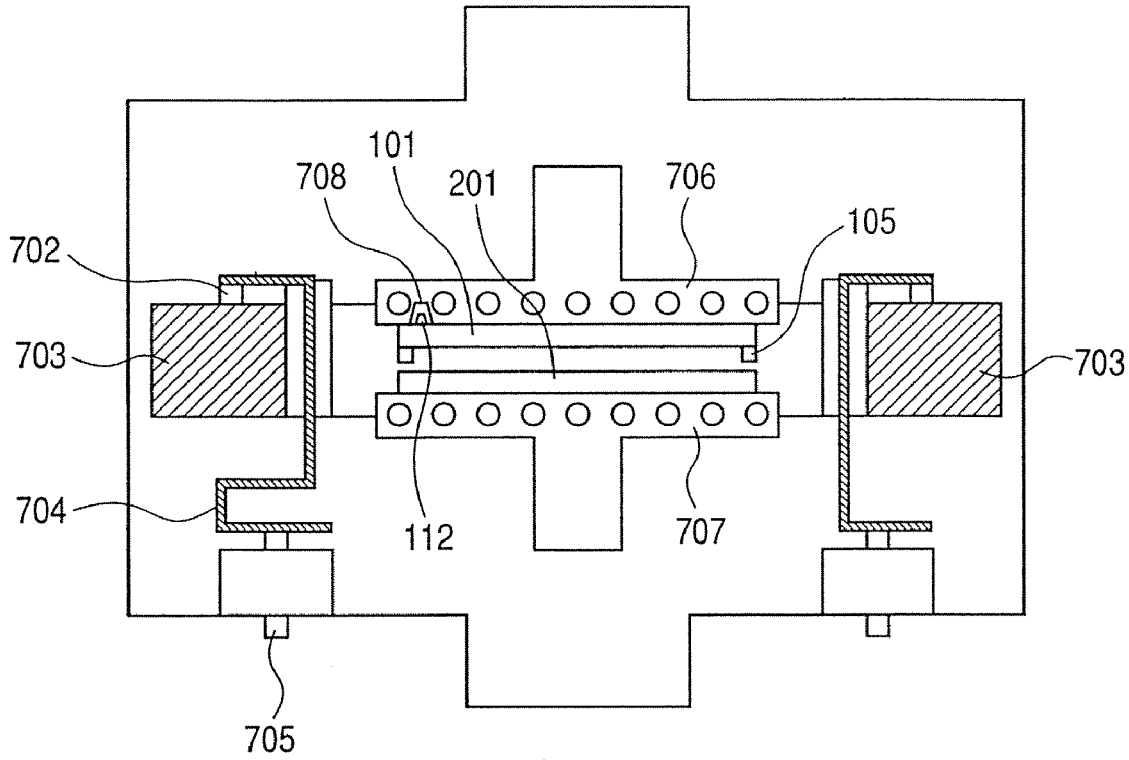
FIG. 7 is a view for explaining the steps of baking, getter flash and seal bonding in a vacuum treatment chamber.

FIG. 7 shows a conceptual diagram of steps performed in a vacuum treatment chamber 603. In FIG. 7, numerical character 706 denotes an upper hot plate and numerical character 707 denotes a lower hot plate, and other components having the same numerical characters as the above described numerical characters denote the same members.

A face plate 201 having a phosphor film 202 and a metallic back film 203 formed thereon and a rear plate 101 having a supporting frame 105 and an ion pump casing 112 connected thereto are together mounted on a transportation holder 604, as shown in FIG. 6, and imported into an atmospherically-opened load chamber 602 through an opened exporting and importing port 601. Then, the load chamber 602 is exhausted into a pressure of $10^{-4}$ Pa or lower. Subsequently, a gate valve 605 communicated to a vacuum treatment chamber 603 which has been previously evacuated with evacuating means 2 (607) into the pressure of about $10^{-5}$ Pa, is opened, the transportation holder 604 is transported to the vacuum treatment chamber 603, and the gate valve 605 is closed.

A usable material for a getter film includes a metal such as Ba, Mg, Ca, Ti, Zr, Hf, V, Nb, Ta, W, and the alloy thereof, but preferably is Ba, Mg, Ca, or an alloy thereof, which is easy-to-handle alkali earth metal with a low vapor pressure. Among them, Ba or the Ba-containing alloy is preferable, because of being inexpensive, capable of easily vaporizing from a metallic capsule for holding a getter material, and industrially and easily manufactured.

Subsequently, an outline of a manufacturing process to be performed in a vacuum treatment chamber 603 is shown in FIG. 7. As is shown in the figure, a face plate 201 and a rear plate 101 are imported to the vacuum treatment chamber 603, are respectively held on a lower hot plate 707 and an upper hot plate 706, and are subjected to degassing treatment of heating and baking treatment. At this time, the rear plate 101 is held on the upper hot plate 706, so that in order to damage an ion pump casing 112 connected to the back surface of the rear plate 101, the upper hot plate 706 has a run off 708 formed therein. A baking temperature can be appropriately selected from temperatures between 50 and 400° C., but a high temperature is preferable as long as the heat resistance of a member allows. Subsequently, the rear plate 101 is moved up simultaneously with separating each of the hot plates to upper and lower directions, and a space is provided above the upper surface of the face plate 201. A lid-shaped holder 703 in one side is moved into the space, and set on the face plate 201. A getter film 204 is formed on a half face of the face plate 201 by supplying an electric current from an outside power source through a brush-shaped contact electrode 705, a wiring terminal 704 and a wiring 702 all for the getter film, and flashing a getter by heating.

Similarly, a getter film 2.04 is formed on a remaining half face. Subsequently, a vacuum chamber (a vacuum envelope) surrounded by a face plate 201, a rear plate 101 and a supporting frame 105 is formed by the steps of: moving a lid-shaped holder 703 toward a previous position; sandwiching again the face plate 201 having an In alloy coated thereon and the rear plate 101 having a supporting frame 105 and an ion pump casing 112 previously connected to itself, in a predetermined position between an upper hot plate 706 and a lower hot plate 707; and applying a load on them while heating them to melt the In alloy. When an image display apparatus for displaying color images is manufactured, the vacuum chamber is formed by matching the positions of a face plate 201 and a rear plate 101 so as to match the positions of a surface conduction type electron-emitting device 104 and an picture element (not shown) of a phosphor film 202 into one-to-one correspondence, and seal-bonding them in a vacuum. Then, it is cooled to about room temperature. Subsequently, an upper hot plate 706 and a lower hot plate 707 are respectively moved in an upper direction and a lower direction, a sealed vessel is transported to a load chamber 602 and taken out from an exporting and importing port 601.

In the steps described above, a space surrounded by a rear plate 101, a supporting frame 105 and a face plate 201 is formed into a vacuum chamber which can keep itself sealed into ambient pressure or lower. Subsequently, a magnet 208 is attached to an ion pump casing 112, and a yoke 211 is attached in some cases. Furthermore, an ion pump power source (not shown), an anode connecting terminal 110 and a cathode connecting terminal 111 are connected by wiring.

A vacuum chamber becomes an image display apparatus through a series of the above described treatments. An ion pump power source (not shown) of the image display apparatus produced as described above is switched on to operate an ion pump 209. Subsequently, scan signals and modulating signals which are picture signals are supplied to each surface conduction type electron-emitting device 104, from scan driving means connected to upper wiring 102 and modulation driving means connected to lower wiring 103.

A drive voltage of a difference voltage between scan signals and modulating signals, in other words, an electrical signal is applied to element electrodes, an electric current passes through an electroconductive thin film 405, one part of the current is changed to electrons at an electron-emitting portion 404 of a crack, and the electrons are emitted as an electron beam in response to the above described electrical signals, are accelerated by a high voltage (1 KV to 10 KV) applied to a metallic back film 203 and a phosphor film 202, and bombard the phosphor film 202 to make phosphors emit light and display images.

In the above processes, the roles of the metallic back film 203 are to improve brightness by mirror-reflecting a light directing to an inner side among lights emitted from the phosphor toward a face plate 201, to act as an electrode for applying an electron beam accelerating voltage, and to protect the phosphor film 202 from being damaged by the bombardment of negative ions generated in the above described sealed vessel.

An ion pump 209 begins operating from an applied voltage of about 1 KV, but as the applied voltage increases, exhaust performance increases. When the applied voltage increases, harmful effects of increasing power consumption and needing a reliable measure for insulation increase. For this reason, a preferably used voltage for efficiently driving the ion pump 209 is 2 KV to 5 KV.

When images are displayed, electrons are emitted to make a member in an image display apparatus release gases. Among these gases, gases such as $H_2$, $O_2$, CO and $CO_2$ which easily damage an electron-emitting device are adsorbed by a getter film 204. On the other hand, Ar of an inert gas is not adsorbed by the getter film 204, but is exhausted by an ion pump 209 that is attached to a rear plate 101, which can control an partial pressure of Ar to $10^{-6}$ Pa that is the pressure for affecting an element, or lower, and as a result, inhibits Ar from damaging an element (destroying the element mainly by sputtering by ionized Ar ions). Accordingly, a provided image display apparatus shows no deterioration of brightness even after having displayed images for a long time, and acquires the long life.

Furthermore, an image display apparatus has magnetic field generating means such as a magnet of an ion pump 209 arranged apart from an image displaying region, and consequently can keep such adequate image displaying characteristics as an orbit of an electron beam is rarely deflected by a magnetic field.

In addition, because a small and lightweight ion pump is directly connected to a rear plate with frit glass, an image display apparatus becomes thin and lightweight. In addition, the provided image display apparatus has the ion pump displaced from an aperture portion communicating with the ion pump, and accordingly even when having a communicating path installed therein with the use of a raising member, can have a shorter depth than that having the ion pump attached in the outside with the use of an exhaust pipe.

A configuration of an image display apparatus according to the present invention is effective to the image display apparatus which employs a field emission type electron-emitting device and a simple matrix type electron-emitting device, other than a surface conduction type electron-emitting device for the above described electron source, and which displays images by controlling electron beams emitted from an electron source with the use of a controlling electrode (grid electrode wiring), other than a simple matrix type.

EMBODIMENTS

Embodiments according to the present invention will be described below with reference to drawings, but the present invention is not limited thereto, and they can be appropriately changed unless it is against an abstract of the present invention.

Embodiment 1

An image display apparatus having a magnet 208 of an ion pump 209 installed at a position apart from an electron-emitting device 120 (an electron source) and a phosphor film 202 to be exposed to electron beams will be explained with reference to FIG. 1, and a method of producing a vacuum chamber of the image display apparatus, with reference to FIGS. 2 to 7.

First of all, a method for producing a sealed vessel of an image display apparatus will be described. Soda glass (SL: product made by Nippon Sheet Glass Co., Ltd.) with a thickness of 2.8 mm and a size of 190×270 mm was used for a face plate 201, and the same soda glass with a thickness of 2.8 mm and a size of 240×320 mm was used for a rear plate 101. In the practically used rear plate 101, an outlet 107 with a diameter of 8 mm was opened at a position outside an image region and on the inside of a glass frame 105.

The film of element electrodes 402 and 403 in a surface conduction type electron-emitting device 120 which is an electron source was formed by forming a film of platinum on a rear plate 101 with a vapor deposition method, and processing the film into a shape having a film thickness of 100 nm, an electrode interval L of 2 μm and an element electrode length W of 300 μm, with a photolithographic technology (including a processing technology such as an etching technique and a lift-off technique).

Subsequently, upper wiring 102 (100 lines) with a width of 500 μm and a thickness of 12 μm and lower wiring 103 (600 pieces) with a width of 300 μm and a thickness of 8 μm were formed on a rear plate 101 each by printing and baking an Ag paste ink. A leading terminal to an external driving circuit was similarly produced. An interlayer insulating layer 401 was formed into a thickness of 20 μm by printing and baking a glass paste (at a baking temperature of 550° C.). Subsequently, the above described rear plate 101 was cleaned, and then a solution of DDS (dimethyl diethoxy silane, a product made by Shin-Etsu Chemical Co., Ltd.) diluted by ethyl alcohol was sprayed with a spraying method, and was heated and dried at 120° C. An electroconductive thin film 405 of a fine particle film consisting of PdO (palladium oxide) particles was formed into a diameter of 60 μm on the rear plate and element electrodes by dissolving 0.15 wt % palladium-proline complex in an aqueous solution consisting of 85% water and 15% isopropyl alcohol, and applying a thus prepared organopalladium-containing solution with an ink-jet coating applicator, and heating it at 350° C. for 10 minutes.

A supporting frame 105 was prepared so as to acquire a shape with a thickness of 2 mm, outer dimensions of 150×230 mm, and a width of 10 mm, by using soda glass (SL, a product made by Nippon Sheet Glass Co., Ltd.) as a material. Onto a surface to be connected to a rear plate 101, LS7305 of frit glass (a product made by Nippon Electric Glass Corporation) was applied with the use of a dispenser. The frit glass was heated and baked at 430° C. for 30 minutes.

An ion pump used in the present embodiment was a bipolar type sputtering ion pump in which a cylindrical anode electrode 108 and a flat cathode electrode 109 facing the flat portion of the cylinder are made of SUS, and the center of the cathode electrode 109 is connected to a Ti electrode 113. The ion pump has a configuration having a cathode connecting terminal 110 and an anode connecting terminal 111 respectively wired to the cathode electrode 108 and the anode electrodes 109 arranged outside the ion pump casing 112.

An ion pump casing 112 has such a size (W 20 mm ×D 25 mm×H 25 mm) as to house the above described cathode electrode 108 and the above described anode electrode 109, and is made of molded glass (PD-200: product made by Asahi Glass Corporation). A cathode connecting terminal 110 and an anode connecting terminal 111 have a structure capable of being connected to the outside with the use of a Dumet wire. The cathode connecting terminal 110 and the anode connecting terminal 111, to which a current can be introduced from outside, are fixed to the ion pump casing 112 with frit and are vacuum-sealed.

Furthermore, an underframe-shaped raising member 210 for forming a communicating path which leads to an ion pump was molded of glass (PD-200: product made in Asahi Glass Corporation). Specifically, the prepared member had the size of W 40 mm×D 25 mm×H 7.5 mm (a plate thickness of 2.5 mm), a shape surrounded by glass plates with a thickness of 2.5 mm from five directions, and a hole with the same diameter as the internal diameter of an ion pump casing 112, on the upper surface.

A raising member 210 was similarly joined to an ion pump casing 112 with a frit. Onto the surface of thus prepared ion pump 209 to be connected to a rear plate 101, LS7305 of frit glass (a product made by Nippon Electric Glass Corporation) was applied with the use of a dispenser similarly to the case of a supporting frame 105. The frit glass was heated and baked at 430° C. for 30 minutes.

Subsequently, a supporting frame 105 and an ion pump casing 112 having a raising member 210 (an underframe) attached thereon were bonded to a rear plate 101 by the steps of: mounting the supporting frame 105 having frit glass 106 coated thereon and the ion pump casing 112 having the raising member 210 (the underframe) thereon on a support for pressing each of them; and heating them to 390° C. in an oven and keeping it at the temperature for 80 minutes while loading the support.

Figure 5:
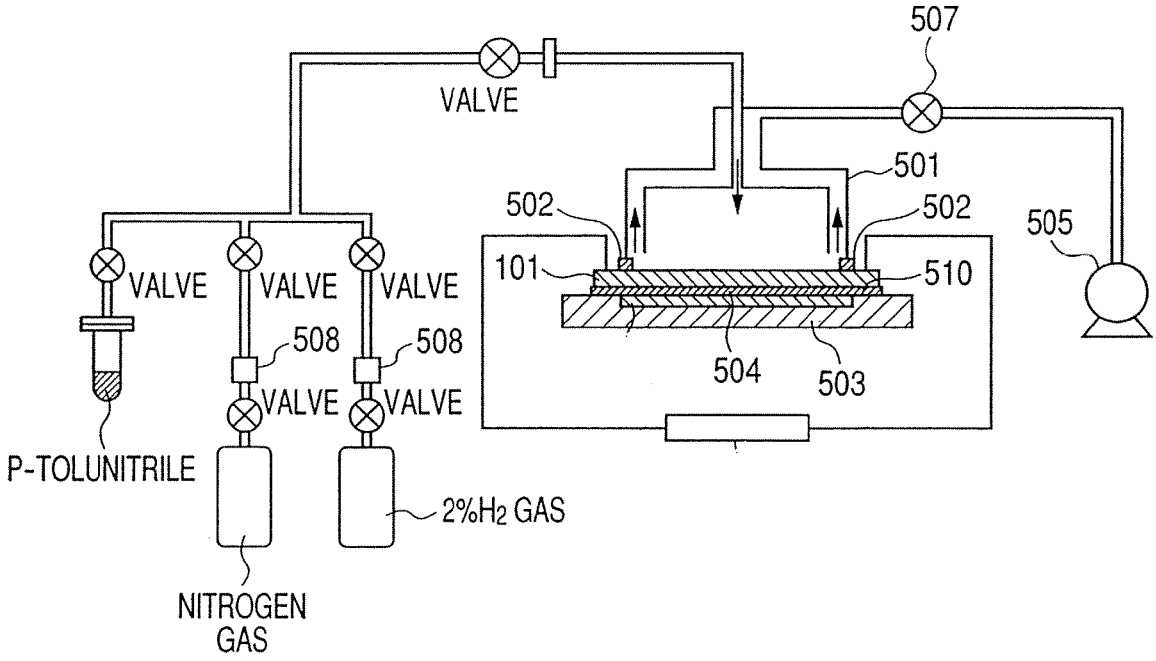
FIG. 5 is a view for explaining a forming/activating step.

A rear plate 101 produced in the above described way was subjected to the following forming treatment and activating treatment using an evacuation apparatus shown in FIG. 5. At first, as shown in FIG. 5, a region except a leading electrode (not shown) of the rear plate 101 arranged on a substrate stage 503 was sealed with an O-shaped ring 502, and the region in the O-shaped ring was covered with a vacuum chamber 501. The substrate stage 503 has a run off (not shown) formed so as not to contact with an ion pump casing 112, and has an electrostatic chuck 504 for fixing the rear plate 101 on the stage. Then, a voltage of 1 KV was applied between an ITO film 510 formed on the back surface of the rear plate 101 and an electrode in the electrostatic chuck, and the rear plate 101 was chucked.

Subsequently, air was exhausted from the inside of a vacuum chamber with a magnetic levitation type turbo molecular pump 505, and the rear plate was subjected to the steps after a foaming step in the following way.

At first, air was exhausted from the inside of a vacuum chamber till the pressure reaches $10^{-4}$ Pa, pulse voltage having a rectangular waveform with a width of 1 milisecond and a voltage of 12 V was applied to upper wiring 102 sequentially at a scroll frequency of 10 Hz. In addition, a lower wiring 103 was grounded. A mixed gas of hydrogen and nitrogen (2% $H_2$ and 98% $N_2$) was introduced into a vacuum chamber, and the pressure was kept to 1,000 Pa. A gas introduction rate was controlled by a mass flow controller 508, whereas an exhaust flow rate from the vacuum chamber was controlled by an exhaust system and a conductance valve 507 for controlling a flow rate. When a value of an electric current passing through an electroconductive thin film 405 reached approximately zero, the application of a voltage was stopped. The forming treatment was finished when the mixed gas of $H_2$ and $N_2$ in the vacuum chamber was exhausted, then a crack was formed in every electroconductive thin film 405 on the rear plate 101, and thus an electron-emitting portion 404 was prepared.

Subsequently, all elements on the rear plate 101 were activated by the activation steps of: evacuating the inside of a vacuum chamber 501 to $10^{-5}$ Pa; introducing tolunitrile (molecular weight: 117) into the vacuum chamber till the partial pressure of tolunitrile reaches $1\times10^{-3}$ Pa; and applying a bipolar voltage of a rectangular waveform to upper wiring 102 while dividing the applying time to the wiring (scrolling) into 10 lines, which had a crest value of ±14V and a pulse width of 1 milisecond.

After activation steps had been finished, tolunitrile remaining in a vacuum chamber 501 was exhausted, the vacuum chamber 501 was returned to an ambient pressure, and a rear plate 101 was taken out.

Subsequently, a supporting frame 105 was applied with In, and a spacer 206 was placed on upper wiring 102 at the spacing of every 20 lines. The spacer 206 was bonded to and fixed on an insulating base which had been installed outside an image display area, with aron ceramic W (a product made by Toagosei Co., Ltd.).

On the other hand, on a face plate 201, a phosphor film 202 was formed so that each phosphor (R, G, B) in a stripe form was alternately separated by a black electroconductive material (black stripe), and then a metallic back film 203 made of an aluminum thin film was formed thereon into a thickness of 200 nm. Subsequently, indium was applied onto a silver paste pattern which had been previously provided on the periphery of the face plate 201.

A rear plate 101 to which the above described supporting frame 105 and an ion pump chamber 209 are joined with frit, and a face plate 201 on which indium was applied were set on a transportation holder 604, and the transportation holder 604 was charged into a load chamber 602 with ambient pressure, through an exporting and importing port 601 of a vacuum treatment apparatus shown in FIG. 6, which had been opened. The exporting and importing port 601 was closed, then the pressure of the load chamber 602 was reduced to about $3\times10^{-3}$ Pa, a gate valve 605 was opened, the transportation holder 604 was imported into a vacuum treatment chamber 603 of which the pressure had been previously reduced to about $1\times10^{-5}$ Pa with evacuating means 2 shown by reference numeral 607, and the gate valve 605 was closed. After the transportation holder 604 was fit into a predetermined position, as shown in FIG. 7, the rear plate 101 was tightly contacted with an upper hot plate 706 and the face plate 201 with a lower hot plate 707, and they were heated at 300° C. for one hour.

Subsequently, a rear plate 101 and one part of a transportation holder 604 supporting it were moved upward together with an upper hot plate 706 by about 30 cm. Then, one lid-shaped holder 703 was inserted into a space between the rear plate 101 and a face plate 201, and was placed on the face plate 201. The barium film of 50 nm thick was formed on a metallic back film 203 on the face plate 201, by sequentially applying an electric current of 12 amperes by every 10 seconds to a container which contains a Ba getter and was installed on a ceiling of an inner side of the lid-shaped holder 703. The lid-shaped holder 703 was returned to the previous position, and the other lid-shaped holder 703 was similarly operated.

Next, a lid-shaped holder 703 was returned to its original position; a rear plate 101, a supporting tool which is one part of a transportation holder 604, and an upper-side hot plate 706 were moved down; and an upper hot plate 706 and a lower hot plate 707 were heated to 180° C. After having had been held at 180° C. for three hours, the rear plate 101, the supporting tool which is one part of the transportation holder 604, and the upper side hot plate 706 were further moved down, and a load of 60 kg/cm$^2$ was applied to the rear plate 101, the face plate 201 and a supporting frame 105. Heating was stopped in the state, they were self-cooled to room temperature, and seal bonding was completed.

A gate valve 605 was opened, a vacuum chamber was exported from a vacuum treatment chamber 603 to a load chamber 602, the gate valve 605 was closed, the pressure of the load chamber 602 was returned to ambient pressure, and a sealed vessel was exported from an exporting and importing port 601. The sealed vessel produced as described above did not show any crack or fracture at all.

An image display apparatus was assembled by the steps of: connecting a sealed vessel to a voltage-applying device and a high-voltage-applying device with a cable so that the sealed vessel can display images; further connecting a cathode connecting terminal 111 and an anode connecting terminal 110 of an ion pump casing 112 to an ion pump power source (not shown) with wires; and mounting a magnet 208 outside an ion pump.

At this time, a distance between a foot of a perpendicular line dropped from an end surface of a magnet 208 onto a rear plate and an image displaying region (the nearest electron source) was 10 mm.

Next, a voltage of 3 KV was applied to an ion pump power source to drive an ion pump 209. In addition, picture signals were supplied to an electron-emitting device from a voltage-applying device connected to an image display apparatus, at the same time a high voltage of 10 KV was applied by a high-voltage-applying device to make a surface conduction type electron-emitting device 104 emit light, and the image display apparatus displayed images.

When a brightness distribution of the image display apparatus was measured, the brightness around an ion pump was reduced by 8% or less with respect to the center of a displaying region.

Figure 8:
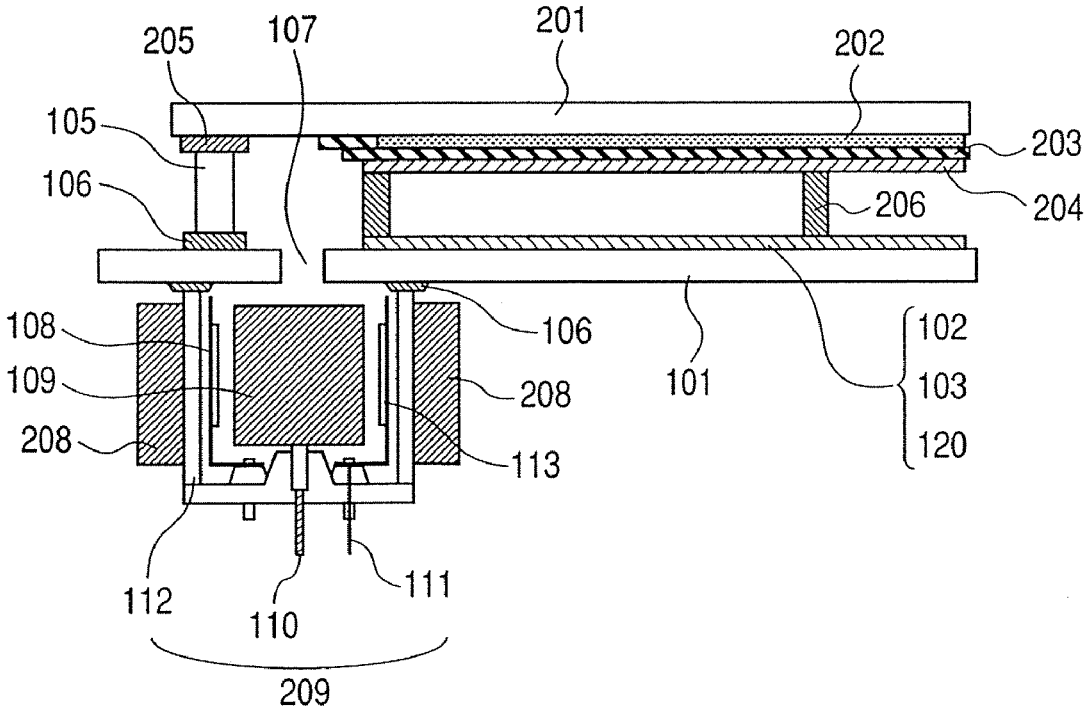
FIG. 8 is a view for explaining a configuration of a comparative example.
Figure 9:
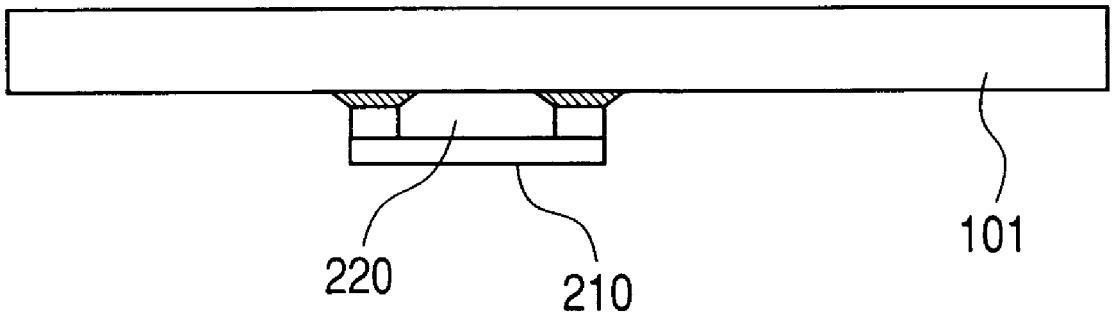
FIG. 9 is a view showing a cross section of a communicating path.

A comparative example in which an ion pump is arranged so that a magnet comes under an image displaying region, as is shown in FIG. 8, showed the reduction of brightness around an ion pump by 60% at the maximum. The reason is considered to be because the trajectory of an electron beam was deflected by the effect of a magnetic field of a magnet, and electrons did not sufficiently hit a desired position of a phosphor.

In order to evaluate the life of an image display apparatus, the image display apparatus was made to continuously display images, and the period of time before brightness was lowered to the half of that at the starting time was measured to have shown 15,000 hours. In addition, the image display apparatus did not show irregularities around an ion pump.

As described above, an image display apparatus produced in the present embodiment showed a uniform display with little unevenness of brightness; had the long life due to an effect of an ion pump, though having had a communicating path arranged with the use of a raising member; and had the ion pump accommodated in a glass housing which is joined to the rear surface of a rear plate with frit, and accordingly had characteristics of causing no leak, being small, thin and lightweight, having high reliability, besides, being inexpensive and capable of easily attaching the ion pump.

Embodiment 2

As is shown in FIG. 2A, an image display apparatus and an ion pump in the present embodiment were produced as in the case of Embodiment 1 except that an ion pump casing 112 was directly bonded to a rear plate 101 with frit glass 106.

A yoke 211 made of iron with a thickness of 2 mm was installed outside a magnet so that as many magnetic lines of force as possible could pass through the yoke. The magnet and the yoke were placed so as not to come right under an electron-emitting device 120 (an electron source). In the present embodiment, the magnet was arranged so that the end of the magnet could be separated from the nearest electron source by 10 mm. In order to separate the end of the magnet and the yoke from the electron source, a larger supporting frame 105 and a larger substrate for a face plate 201 than usual were used.

When a brightness distribution of the image display apparatus prepared in Embodiment 2 was measured, the brightness even around an ion pump was reduced by as little as 10% or less with respect to the center of a displaying region.

Furthermore, in order to evaluate the life of an image display apparatus, the image display apparatus was made to continuously display images, and the measured brightness was higher than the half of the initial value even after a displaying period of 15,000 hours. The image display apparatus also did not show irregularities around an ion pump.

The image display apparatus using a yoke and a consequent thin magnet as in the present embodiment could similarly operate an ion pump; and similarly to Embodiment 1 had characteristics of causing no leak, being small and lightweight, having high reliability, being inexpensive and capable of easily attaching the ion pump.

Embodiment 3

As an ion pump is shown in FIG. 2B, the central axis of the ion pump was displaced from the central axis of an aperture portion 107 toward an opposite direction to an imaging region. By doing so, a supporting frame 105 and a substrate for a face plate 201 similar to Embodiment 1 could be used. Except the above points, an image display apparatus and the ion pump were produced as in the case of Embodiment 1. A yoke 211 made of iron with a thickness of 2 mm was installed outside a magnet so that as many magnetic lines of force as possible could pass through the yoke. The magnet and the yoke were placed so as not to come right under an electron-emitting device 120 (an electron source). In the present embodiment, the magnet was arranged so that the end of the magnet could be separated from the nearest electron source by 10 mm.

When a brightness distribution of the image display apparatus prepared in Embodiment 3 was measured, the brightness even around an ion pump was reduced by as little as 10% or less with respect to the center of a displaying region.

Furthermore, in order to evaluate the life of an image display apparatus, the image display apparatus was made to continuously display images, and the brightness measured after a displaying period of 15,000 hours was higher than the half of the initial brightness. The image display apparatus also did not show irregularities around an ion pump. The image display apparatus also had characteristics of causing no leak, being small and lightweight, having high reliability, being inexpensive and capable of easily attaching the ion pump similarly to Embodiment 1.

Embodiment 4

The image display apparatus and the ion pump were produced as in the case of Embodiment 1, except that a yoke 211 was installed in an image display apparatus of Embodiment 1 as in the case of Embodiment 2.

When a brightness distribution of the image display apparatus prepared in Embodiment 4 was measured, the brightness even around an ion pump was reduced by as little as 5% or less with respect to the center of a displaying region, which implied the effect of a yoke. The image display apparatus in the present embodiment of the present invention had little irregularity of brightness the long life and the characteristics of causing no leak, being small and lightweight, having high reliability, being inexpensive and capable of easily attaching the ion pump similarly to Embodiment 1.

This application claims priority from Japanese Patent Application No. 2004-248603 filed on Aug. 27, 2004, which is hereby incorporated by reference herein.

What is claimed is:

1. An image display apparatus provided with a vacuum chamber that is constituted by an electron source substrate having a plurality of electron-emitting devices arranged thereon, and by an image forming substrate which is arranged so as to face the electron source substrate, and has a phosphor film and an anode electrode film thereon, wherein an ion pump is connected to an aperture portion formed in the electron source substrate or the image forming substrate, in such a way that a shadow formed by perpendicularly projecting magnetic field generating means of the ion pump onto the electron source substrate or the image forming substrate can not exist in an image displaying region of the image display apparatus.

2. The image display apparatus according to claim 1, wherein the projected shadow is 1 mm or more distant from the image displaying region.

3. The image display apparatus according to claim 1, wherein the central axis of the aperture portion is displaced from the central axis of the ion pump.

4. The image display apparatus according to claim 1, wherein the casing of the ion pump is connected to the aperture portion through a communicating path.

5. The image display apparatus according to claim 4, wherein the communicating path is formed by using the surface of the electron source substrate or the image forming substrate to which the ion pump is connected, as one wall surface.

6. The image display apparatus according to claim 1, wherein the magnetic field generating means is provided with a yoke.

7. The image display apparatus according to claim 6, wherein a shadow formed by perpendicularly projecting the yoke onto the electron source substrate or the image forming substrate does not exist in the image displaying region of the image display apparatus.

8. An image display apparatus comprising: a vacuum chamber that is constituted by a rear substrate having an image displaying region containing a plurality of electron-emitting devices arranged on the surface, and by a face substrate which is arranged so as to face the rear substrate, and has a phosphor film and an anode electrode film thereon; and an ion pump which is connected to an aperture portion formed in the rear substrate, and has magnetic field generating means arranged on the back surface of the rear substrate, wherein there is a space between a region orthogonally projected by the magnetic field generating means on the back surface of the rear substrate and the region on the back surface of the rear substrate corresponding to an image displaying region.

9. The image display apparatus according to claim 8, wherein the space is 1 mm or wider.

10. The image display apparatus according to claim 8, wherein the central axis of the aperture portion is displaced from the central axis of the ion pump.

11. The image display apparatus according to claim 8, wherein the casing of the ion pump is connected to the aperture portion through a communicating path.

12. The image display apparatus according to claim 11, wherein the communicating path is formed by using the surface of the rear substrate to which the ion pump is connected, as one wall surface.

13. The image display apparatus according to claim 12, wherein the magnetic field generating means is provided with a yoke, and there is a space between a region orthogonally projected by the yoke onto the back surface of the rear substrate and the region on the back surface of the rear substrate corresponding to the image displaying region.

14. The image display apparatus according to claim 8, wherein the magnetic field generating means is a permanent magnet or an electromagnet.

15. An image display apparatus comprising:

a rear plate having a plurality of electron-emitting devices, a face plate opposed to the rear plate, an ion pump having a magnetic field generator connected to an aperture portion formed in the rear plate or the face plate, wherein an orthogonal projection of the magnetic field generator onto the rear plate is located outside an image displaying region of the image display apparatus.

* * * * *